US006501039B1

(12) United States Patent
Mattlar et al.

(10) Patent No.: US 6,501,039 B1
(45) Date of Patent: Dec. 31, 2002

(54) REMOTE TRIP MECHANISM OF A SWITCH DEVICE

(75) Inventors: Harri Mattlar, Iskmo (FI); Ilmari Mäenpää, Vaasa (FI)

(73) Assignee: ABB OY, Helsinki (FI)

( * ) Notice: Subject to any disclaimer, the term of this patent is extended or adjusted under 35 U.S.C. 154(b) by 0 days.

(21) Appl. No.: 09/600,200

(22) PCT Filed: Jan. 29, 1999

(86) PCT No.: PCT/FI99/00065

§ 371 (c)(1),
(2), (4) Date: Aug. 31, 2000

(87) PCT Pub. No.: WO99/40595

PCT Pub. Date: Aug. 12, 1999

(30) Foreign Application Priority Data

Feb. 3, 1998 (FI) ..... 980243

(51) Int. Cl.[7] ..... H01F 3/00
(52) U.S. Cl. ..... 200/502; 200/17 R
(58) Field of Search ..... 200/502, 16 R, 200/529, 6 R, 16 E, 16 C, 17 R, 18, 43.01, 50.01, 523, 533, 320, 32, 323; 335/132

(56) References Cited

U.S. PATENT DOCUMENTS 5,689,095 A * 11/1997 Kawase ..... 200/5 R
5,886,311 A * 3/1999 Morel et al. ..... 200/17 R

FOREIGN PATENT DOCUMENTS

WO 1-9505673 2/1995

* cited by examiner

*Primary Examiner*—Lincoln Donovan
*Assistant Examiner*—Lisa N Klaus
(74) *Attorney, Agent, or Firm*—Birch, Stewart, Kolasch & Birch, LLP

(57) ABSTRACT

The present invention relates to a switch device for controlling electrical equipment. Such a switch device comprises a body piece (15), a sliding member (14) and contact surfaces controlled by the sliding member (14), means for latching the sliding member (14) into a closed/open position of the switch and for unlatching the sliding member (14) from said positions, a spring-arming plate (11) and switch actuator springs (10). The invention is implemented by making a slot (33) into the sliding member (14) that controls the second movable set of contact surfaces in the switch and adapting compatible interlock means (34) to the housing or body piece (15) of the switch, said interlock means serving to inhibit the movement of said sliding member (14) by virtue of partially entering the slot (33) made into the sliding member (14). Additionally, the spring-arming plate (11) is provided with a projection (32) capable of covering the slot (33) made into the sliding member (14) and thus preventing the interlock means (34) from inhibiting the movement of the sliding member (14) when the switch is being opened or closed. The switch device is also provided with another set of springs (31) for storing the mechanical energy required for a remote-controlled operation.

10 Claims, 5 Drawing Sheets

REMOTE TRIP MECHANISM OF A SWITCH DEVICE

This application is the national phase under 35 U.S.C. §371 of PCT International Application No. PCT/FI99/00065 which has an International filing date of Jan. 29, 1999, which designated the United States of America.

BACKGROUND OF THE INVENTION

Field of the Invention

The present invention relates to a secured switch device having one set of surfaces forming an electrical contact guided by a sliding member and said device further including a spring-arming plate, a control shaft actuating the same spring-like elements for transmitting the movement of the spring-arming plate to the sliding member and thence further to the contact surfaces.

DESCRIPTION OF BACKGROUND ART

From patent publication FI 93502 is known a switch device in which the control lever is at all times movable in a clear and unambiguous manner from one position into another position and the construction of the device excludes the possibility of allowing the electrical contact surfaces to assume an intermediate position. This arrangement prevents the occurrence of excessively long arcs caused by too slow an opening or closing of the contact surfaces, whereby the switch device is protected from damage due to arcing. The switch device is latched in the open and closed positions by means of both mechanical and spring forces, thus assuring positive latching of the switch device in the desired position. The switch device further includes a mechanical force-separating means that separates the contact surfaces should they happen to be welded together. In the case that contact welding has been so intense as not to permit the contact surfaces to be separated from each other, the control lever of the switch device returns to the "closed" position. Hence, no ambiguity about the switch status can occur.

The function of this kind of switch device is implemented by mounting into the switch housing at least one linearly movable sliding member with contacts thereon adapted to cooperate with the stationary contacts of the switch. To the sliding member is via at least one spring-type member connected a spring-arming plate adapted to move in parallel with the sliding member. The spring-arming plate is constructed so that, during the motion of said spring-arming plate, the spring elements cause the sliding member to move correspondingly. One of the advantages of this construction is that the spring-arming plate controls the switching action in an operator-independent manner and always at a high speed, whereby the electrical contacts close and open rapidly and the duration of arcing is minimized. The actual connection step is thus performed at all times with a constant speed forced by the armed springs independently from rotating speed of the switch control lever. Such a switch cannot be inadvertently operated in an incorrect manner.

While the switch device disclosed in patent publication FI 93502 is highly useful, it cannot be employed universally in all applications inasmuch it lacks a remote control function. Today, there is a wide need for a switch device equipped with a remote-control facility. Such a switch device should desirably have the good manual control and switching properties of the above-described prior-art device complemented with facilities fulfilling the following requirements:

The remote-trip function of the device may not interfere with the manual-control properties of the device meaning that switch devices equipped with a remote-trip facility must be usable in the same fashion as switch devices not equipped with a remote trip option.

The switch device must be remote-controllable, e.g., through actuating by means of a solenoid a lever on the switch housing, from its I (closed) position into a Trip position representing an intermediate mechanical state with an electrically open circuit between the I and O (open) positions of the switch.

The switch device must have an auxiliary contact serving to indicate said Trip status.

The switch construction shall not allow direct control of the switch from its Trip status into position I; however, an attempt to do so may allow the manual control lever to move, while the electrical contact surfaces must remain unmoved.

Rearming of the switch device from its Trip status must take place via a Reset action. If so desired, the O position may also serve as the Reset position.

SUMMARY AND OBJECTS OF THE INVENTION

It is an object of the invention to eliminate the shortcomings of the above-described prior art devices and to provide an entirely novel kind of a switch device capable of fulfilling the above-stated requirements.

The goal of the invention is achieved by providing a slot in the sliding member guiding the second set of contact surfaces in the switch and equipping the switch housing or body piece with a latch assembly capable of inhibiting the movement of the sliding member through partially entering into the slot of the sliding member. Additionally, the spring-arming plate is provided with a projection adapted to cover the slot of the sliding member, thus inhibiting the latch assembly from interrupting the movement of the sliding member when the switch is manually thrown between its open and closed positions. The switch device is further provided with a second set of springs serving to store the mechanical energy required to actuate the remote-controlled trip function.

More specifically, the switch device according to the invention is characterized by what is stated in the characterizing part of claim 1.

The invention offers significant benefits: a switch device according to the invention provides reliable, durable and safe operation. Rapid changeover between positions is assured in the switch device by mechanical means and, according to the invention, the switch device can also be tripped in a remote-controlled manner. Manual use of the switch device after remote-controlled tripping requires a mandatory arming (Reset) operation and the liberated position of the operating lever always indicates the real status of the mutual disposition of the switch device contact surfaces. These qualities reduce the risk of misinterpretation of switch device status.

BRIEF DESCRIPTION OF THE DRAWINGS

In the following, the invention will be examined with the help of exemplifying embodiments by making reference to the attached drawings, in which.

DETAILED DESCRIPTION OF THE PREFERRED EMBODIMENTS

Figure 1:
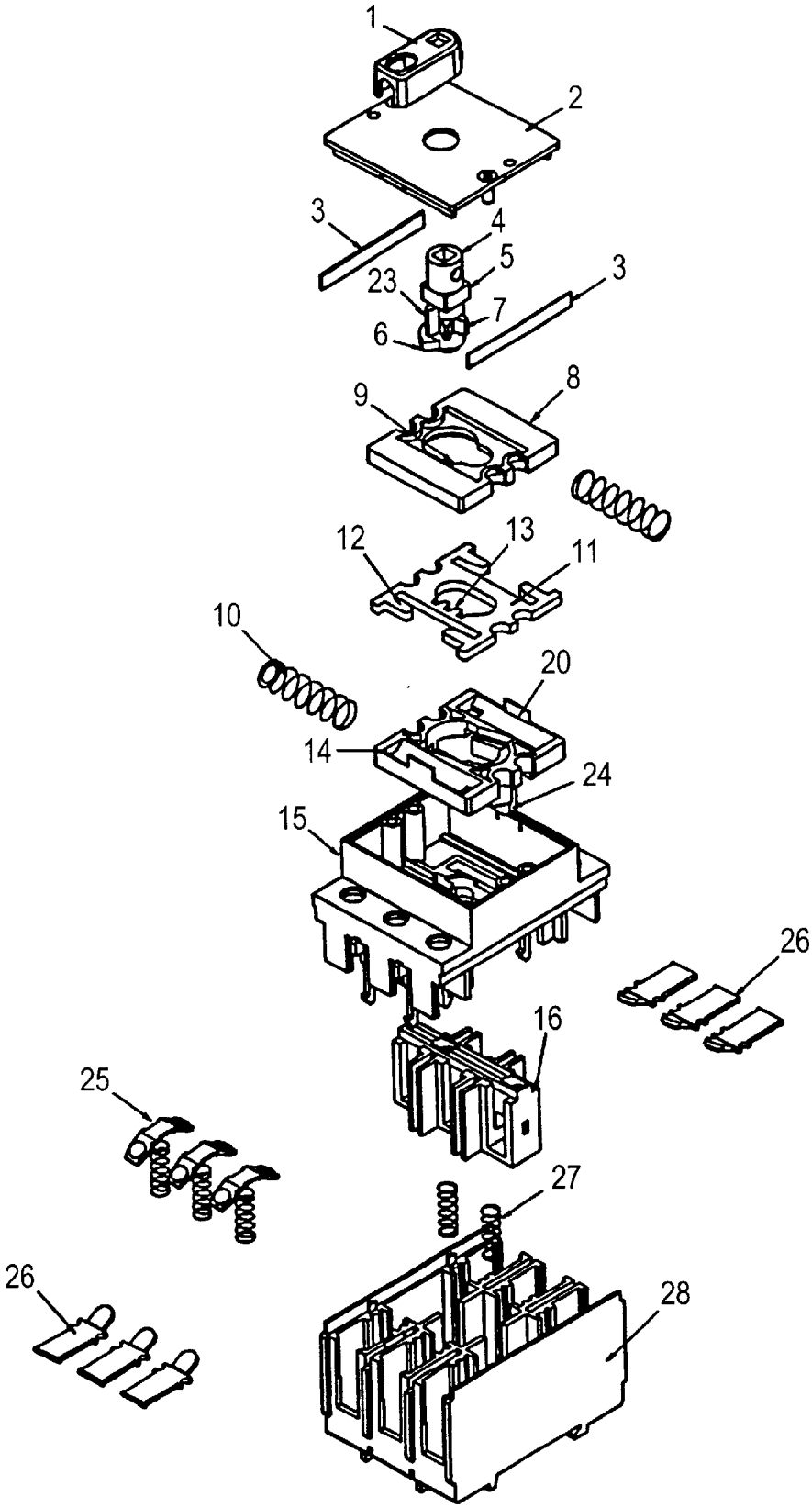
FIG. 1 shows a switch device concerned in the invention with the remote-controlled trip mechanism according to the invention omitted therefrom.
Figure 2:
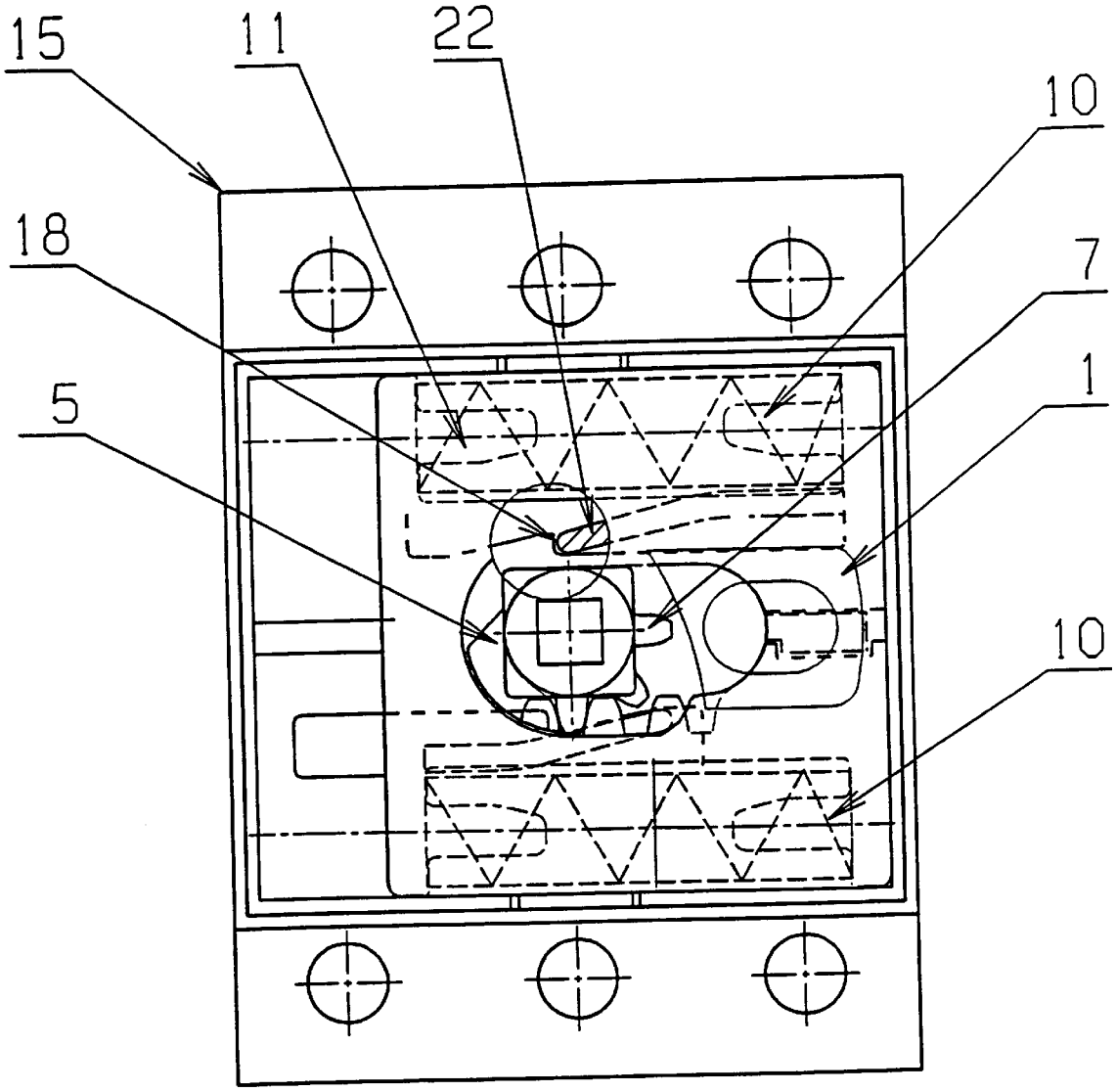
FIG. 2 shows a latch mechanism for the sliding member of the switch device illustrated in FIG. 1.

Referring to FIGS. 1 and 2, the basic construction of a switch device is first described having a design compatible with the concept of the invention. In this embodiment, the housing of the switch device comprises a body piece 15 and a contact bridge 16, the latter communicating via a slanted sliding surface with a lower sliding member 14. The contact bridge 16 is connected via springs 27 to a housing 28. The electrical contact is accomplished by virtue of moving the lower sliding member 14 which moves via the slanted surface 24 the moving contacts 25 of the contact bridge 16 in regard to the stationary contacts 26. Switch actuator springs 10 are adapted into the spaces remaining to both sides about the opening in the center of the lower sliding member 14, whereby the spring ends are held by pegs 12 of a spring-arming plate 11. Above the spring-arming plate 11 there is mounted an upper sliding member 8 which is connected to the lower sliding member 14 by fastening clips 20. A switch control shaft 4 is passed through openings of the lower sliding member 14, the spring-arming plate 11 and the upper sliding member 8. To both sides of the control shaft 4 there are adapted detent springs 3 arranged to rest on a detent cam made on the shaft 4. The lower end of the control shaft 4 is provided with cam tips 6, and transfer teeth 7 and 23 are made on the shaft section between the cam tips 6 and the detent cam 5.

The mounting well of the body piece 15 is closed with a cover 2 and the manual control lever 1 of the switch device is attached to the upper end of the control shaft 4 passed through the cover 2. Locking shoulders 18 are provided in the latch slots made to the bottom of the mounting well of the body piece 15. The locking shoulders 18 serve to inhibit the movement of the lower sliding member 14 by catching the elastic fingers 22 of the lower sliding member 14. The function of the fingers 22 is controlled by the cam tips 6 made on the control shaft 4. The inside surface of the opening in the center of the spring-arming plate 11 is provided with teeth 13 with a pitch compatible with the transfer teeth 7 made on the control shaft 4. The opening in the upper sliding member 8 is contoured into an inside force-control cam surface 9 adapted to cooperate with the outermost tooth 23 of the transfer teeth 7 made on the control shaft 4 which is passed through the opening.

The function of the switch is principally as follows. In FIG. 2 the switch is shown in its (open) position O. In this state, the transfer teeth 7 of the control shaft 4 has moved the spring-arming plate 11 to the right-hand side of the mounting well. The switch actuator springs 10 push the lower and upper sliding members 8 and 14 to the same side. The first locking finger 22 of the lower sliding member 14 rests abutting the locking shoulder 18 thus locking into a stationary position the lower sliding member 14 as well as the upper sliding member 8 fastened thereto by means of the fastening clips 20. When the control shaft 4 is rotated clockwise, the transfer teeth 7 push the spring-arming plate 11 to the left, whereby the switch actuator springs 10 will be armed. After the manual control lever 1 has almost reached its closed position, the cam tip 6 of the control shaft 4 begins to press the first locking finger 22 so as to lift the finger 22 off from the slot of the locking shoulder 18. The sliding members 8 and 14 can now move to the other side of the mounting well under the force exerted by the switch actuator springs 10. The electrical contact is accomplished simultaneously with the transfer of the lower sliding member 14, and the switch is latched in the closed position (position I). As the lower sliding member 14 moves to the other side of the mounting well, the other locking finger 22 which is opposite to said first locking finger 22 locks the lower and upper sliding members 14 and 8 in place. Throwback from position I to position O takes place in an analogous manner.

In the following, a possible embodiment of the invention is presented suitable for use in conjunction with the switch device basic design illustrated in FIGS. 1 and 2.

In FIGS. 3–8 are shown the switch device components equivalent to those of the basic construction: control shaft 4, switch actuator springs 10, spring-arming plate 11, lower sliding member 14 and switch body piece 15. Additions in the present embodiment as compared to the basic construction are: trip lever 30, Trip actuator springs 31, interlock claw 32, latch slot 33, Trip brake 34 and slanted projection 35.

The trip lever 30 is an elongated member passing through the switch body piece 15 and having its distal end extending into the interior of the switch mechanism connected to cooperate with the locking finger 22 (FIG. 2) that holds the switch in its position I. The trip lever 30 is so adapted in the switch body and positioned in respect to the locking finger 22 that the rotation of the trip lever 30 bends the locking finger 22 thus unlatching the lower sliding member 14 in a similar fashion as the rotation of the control shaft 4 by means of the manual control lever 1 toward position O of the switch. For remote-controlled operation, the trip lever 30 can be actuated by means of a solenoid. The Trip actuator springs 31, which are similar to the switch actuator springs 10, however, smaller and less stiff, are placed in the space between the outer cover 15 of the switch housing and the spring-arming plate 11. The function of the Trip actuator springs 31 is to exert on the spring-arming plate 11 such a force with respect to the body piece 15 that tends to shift the spring-arming plate 11 toward a position of the plate that corresponds to switch position O.

Figure 5:
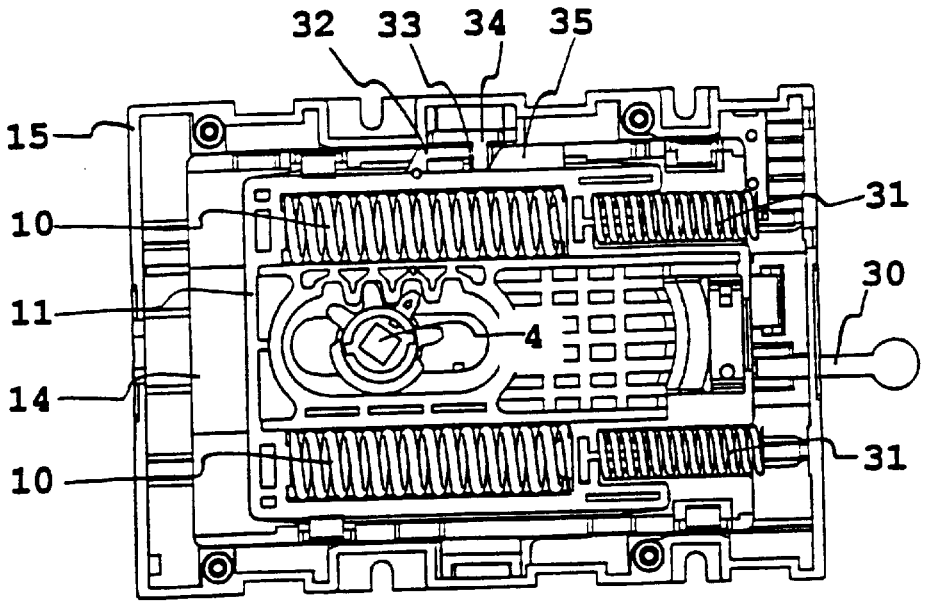
FIG. 5 shows the mechanism illustrated in FIG. 3 in its position Trip.

A functional entity of the switch is formed by the combination: interlock claws 32 and slanted projection 35 at the edge of the spring-arming plate 11, latch slot 33 made to the lower sliding member 14 and Trip brake 34 adapted in the body piece 15. The Trip brake 34 is formed by a brake element proper and spring-like elements serving to push the tip of the brake element against the side surface of the lower sliding element 14. The tip of the brake element and the latch slot 33 at the side surface of the lower sliding element 14 are so shaped and placed that, when the lower sliding member 14 is essentially at the center of its travel, the tip of the brake element can enter the latch slot 33, thus inhibiting the movement of the lower sliding member 14 (FIG. 5). A pre-condition of this function is that the operation of the Trip brake 34 is not inhibited.

The entry of the Trip brake 34 into the latch slot 33 can be inhibited by means of the interlock claw 32 or, alternatively, a projection with a slanted surface 35, both interlocking elements being situated at the edge of the spring-arming plate 11, on the same side of the switch housing as the Trip brake 34 and the latch slot 33. The interlock claw comprises one elongated part aligned parallel to the edge of the spring-arming plate 11 and a second part serving to connect said first part to the spring-arming plate 11. The outer edge of the elongated part is adapted in the width direction of the lower sliding member 14 so as to coincide with the edge of said member 14 and in its thickness direction so as to locate the elongated part essentially at the center of the tip of the Trip brake 34. The slanted projection 35 is placed correspondingly. The parts 32 and 35 are arranged so that, when viewed along the edge of the spring-arming plate 11 in the direction required to move the lower sliding member 14 from position O into position I of the plate 14 (direction O→I), the first item is the fixing point of the interlock claw 32, followed by its elongated part. Next, disposed at a distance slightly longer than the tip width of the Trip brake 34, are located the slanted surface comprising the projection 35.

Figure 7:
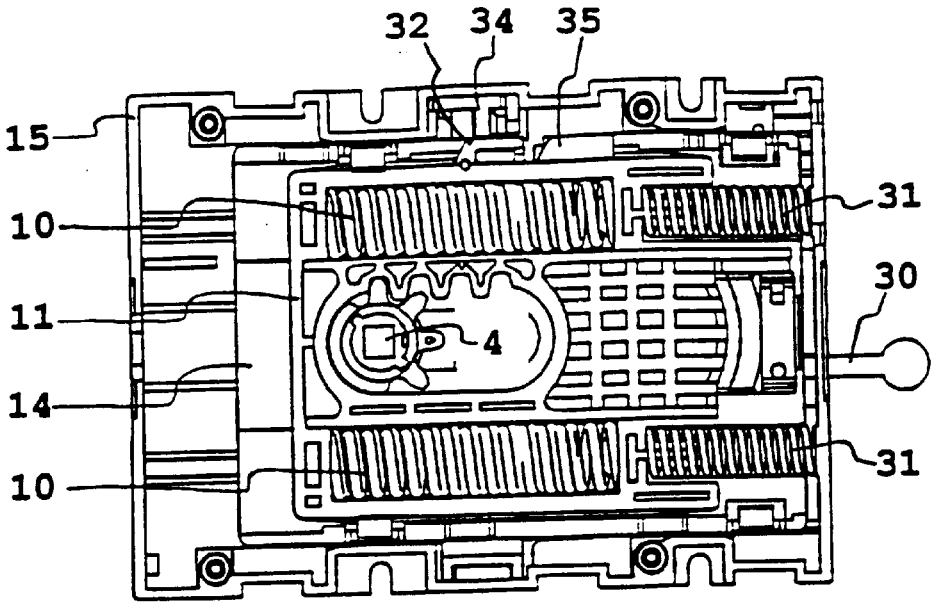
FIG. 7 shows the mechanism illustrated in FIG. 3 in position I.

The lengths and positions of the interlock claw 32 and the projection 35 in the longitudinal direction of the spring-arming plate 11 are determined so that the tripping of the Trip brake 34 is possible only when the mutual disposition of the spring-arming plate 11 and the lower sliding member 14 corresponds with a good accuracy to their mutual disposition in position I of the switch (FIGS. 5 and 7). Hence, the tip of the Trip brake 34 can enter the latch slot 33 only when the spring-arming plate 11 is located essentially in the center area of its travel in regard to the lower sliding member 14.

Figure 6:
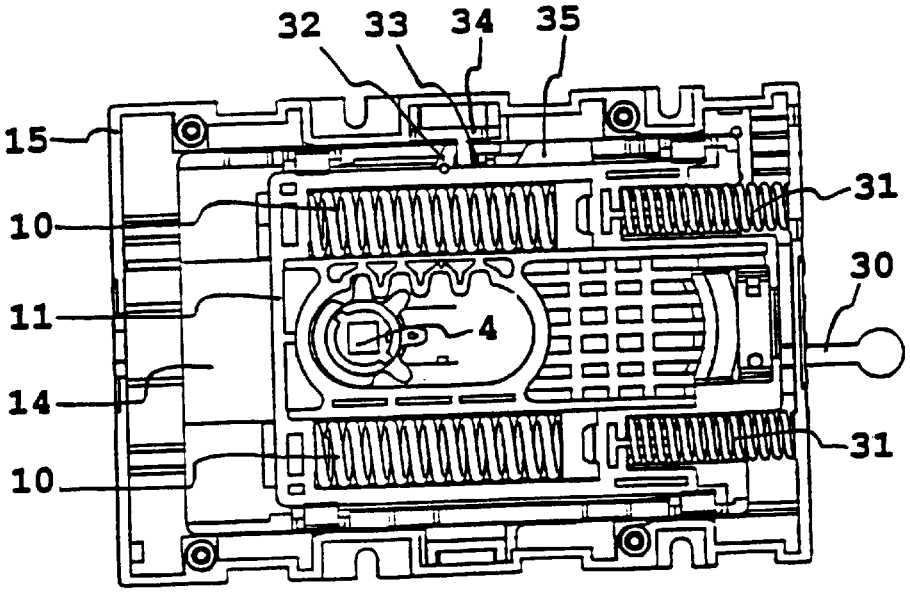
FIG. 6 shows the mechanism illustrated in FIG. 3 with the sliding member in its position Trip and the control lever turned into position I.

In a plane perpendicular to the longitudinal direction of the spring-arming plate 11 and the elongated part of the interlock claw 32, the tip of the Trip brake 34 is provided with such a hole or opening through which the elongated tip of the interlock claw 32 can enter when the Trip brake 34 is in an interlocking position to the movement of the lower sliding member 14. This means that the tripping of the Trip brake 34 will interlock the movement of the lower sliding member 14 but not the movement of the spring-arming plate 11. During the movement of the spring-arming plate 11 in switch state changeover direction Trip→I, the tip of the interlock claw 32 will enter the above-mentioned hole or opening and the spring-arming plate 11 moves in regard to the lower sliding member 14, whereby mechanical energy will be stored in the switch actuator springs 10 (FIG. 6). However, there will be no state changeover in the switch. By contrast, when the spring-arming plate 11 moves in switch state changeover direction I→O, also the projection 35 will move toward the Trip brake 34, whereby during this movement the slanted surface of the projection 35 will lift the Trip brake 34 off from the latch slot 33 thus unlatching the lower sliding member 14.

Accordingly, the switch device has three positions, namely position O, position I and position Trip. In the following, the state changeover between these positions is described.

Figure 3:
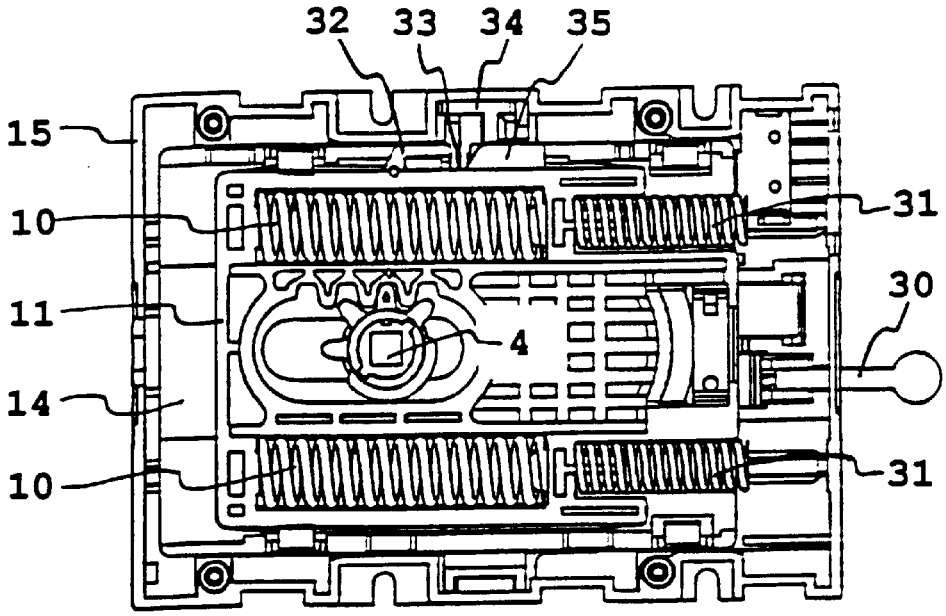
FIG. 3 shows in a partially sectional view a remote-controlled trip mechanism according to the invention in position O.
Figure 4:
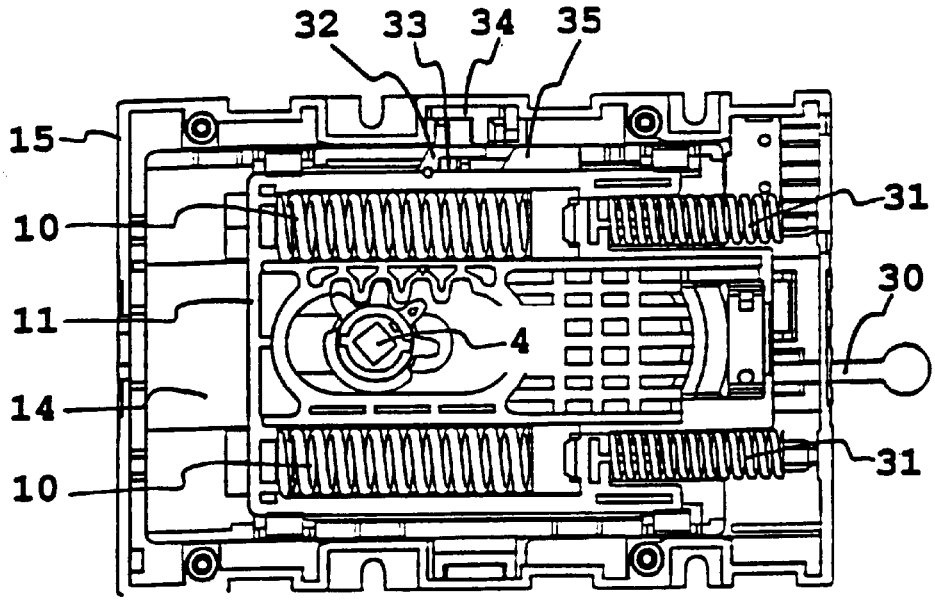
FIG. 4 shows the mechanism illustrated in FIG. 3 in its position O and armed for tripping into position I.

In FIG. 3 is shown the switch device in position O, whereby the electric circuit controlled by the switch is opened. From position O, the switch can be thrown only into position I. This occurs by rotating the manual control lever 1, whereby the spring-arming plate 11 will move and the switch actuator springs 10 are armed. The interlock claw 32 of the spring-arming plate 11 moves into a position in front of the Trip brake 34 (FIG. 4) which at this moment rests against the edge of the lower sliding member 14. With a further rotation of the manual control lever 1, the switch mechanism will be triggered, and the lower sliding member 14 moves into position I (FIG. 7). The interlock claw 32 inhibits the operation of the Trip brake 34 at the instant the latch slot 33 of the lower sliding member 14 moves past the tip of the Trip brake 34.

Figure 8:
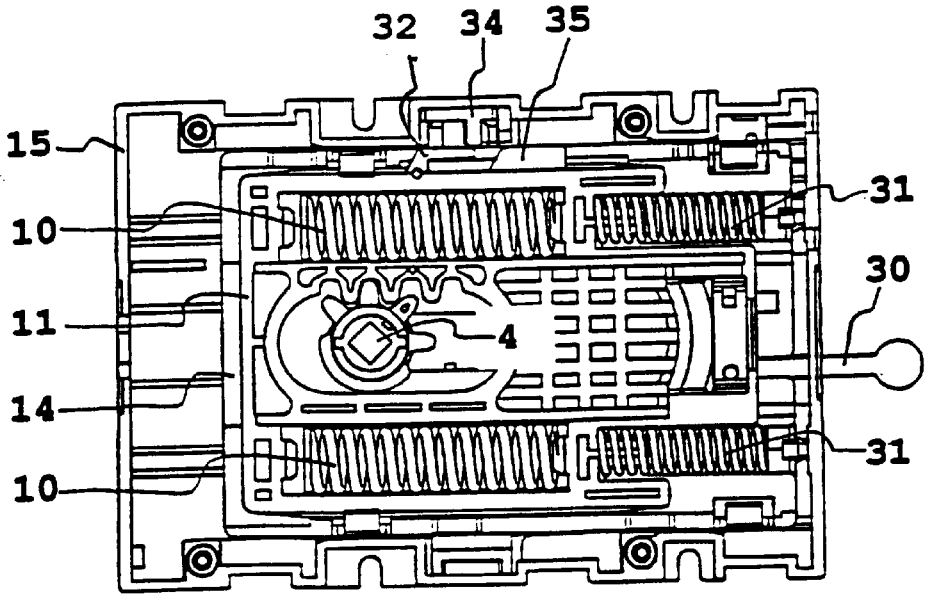
FIG. 8 shows the mechanism illustrated in FIG. 3 in position I and armed for tripping into position O.

In FIG. 7 the switch is shown in position I. Depending on the type of trigger, the switch may change from this state into position Trip or position O. To set the switch into position O, the manual control lever 1 must be rotated correspondingly in a direction which now is opposite to that required above for changing the switch state in direction O→I. Also in this situation, the interlock claw 32 will inhibit the operation of the Trip brake 34 (FIG. 8). The switch can be triggered into position Trip by releasing the locking of the lower sliding member 14 through operating the trip lever 30. Then, the mechanical energy stored in the Trip actuator springs 31 will be released as the springs 31 push the spring-arming plate 11 and, via the stiffer switch actuator springs 10 connected thereto, further the lower sliding member 14 in direction I→O. During this movement, both the length of the switch actuator springs 10 and simultaneously the mutual disposition of the lower sliding member 14 and the spring-arming plate remain essentially unchanged. Hence, when the latch slot 33 of the lower sliding member 14 passes the Trip brake 34, the tip of the brake 34 can enter the latch slot 33, whereby the lower sliding member will be locked in position Trip as shown in FIG. 5.

Accordingly, the switch position Trip is an intermediate state between position O and position I, whereby the lower sliding member 14 and the manual control lever 1, for instance, are located in the midway between their positions O and I. In this state, the switch is open when triggered into position Trip; however, if the switch is provided with a separate contact, the Trip state of the switch can be indicated to the remote-controlling system. The Trip state is illustrated in FIG. 5.

Using the manual control lever 1, it is possible to attempt moving a switch in position Trip into position I. Then, the spring-arming plate 11 will move in direction O→I under the force exerted by the transfer teeth 7 of the control shaft 4. The switch actuator springs 10 will be armed and the tip of the interlock claw 32 will enter the hole or opening made to the tip of the Trip brake 34. However, the lower sliding member 14 remains locked by the Trip brake 34 and the contact surfaces of the switch remain unmoved. The switch is shown in this state in FIG. 6. Accordingly, it is possible to rotate the manual control lever 1 in a normal fashion into position I without causing a state changeover of the switch. However, when the manual control lever 1 so rotated is liberated, the mechanical energy stored in switch actuator springs 10 is released and the manual control lever 1 returns back to indicate the remote-triggered Trip state. Hence, the switch state will be indicated in an unambiguous manner.

The reset of the switch from position Trip (FIG. 5) occurs by rotating the manual control lever 1 into position O. Then, the spring-arming plate 11 will move in changeover direction I→O and the slanted surface of the projection 35 made on the spring-arming plate 11 lifts the Trip brake 34 off from the latch slot 33. Subsequently, the lower sliding member 14 will follow the movement of the spring-arming plate 11 under the force exerted by the switch actuator springs 10, and the switch with its contact surfaces will be locked into position O.

In addition to the preferred embodiment of the invention described above, the present invention can be implemented in a plurality of alternative manners. The application of the invention is not limited to merely improving the switch construction shown in FIGS. 1 and 2, but rather, the remote-controllable trip mechanism according to the invention may as well be utilized in many other kinds of switches having their switching mechanism implemented in the form of a reciprocatingly moving sliding member. The use of such a switch need not necessarily be limited to the control of electrical energy. Further, the implementation technique of the invention need not be limited by what is described above.

In the above-described embodiment, the remote-controlled tripping is implemented by virtue of using a trip lever 30 to control a locking finger 22 resting against a locking shoulder 18. However, the tripping action may as well be carried out using any type of actuator mechanism such as a flexible cable or, alternatively, designing the switch device so that the locking finger can be directly actuated by a solenoid, for instance. In principle it is also possible to implement a remote-controlled trip function by way of directly controlling the locking shoulder, and the concept of the invention may further be applied to switch designs having a latch mechanism different from that described above.

The switch design shown in FIGS. 3–8 has two Trip springs 31. In alternative embodiments of the invention, the number of springs may as well be varied from one to four, for instance, and their size, shape and exact location in the switch construction may differ from those shown in the exemplifying embodiment. The springs may also be replaced by any other means capable of releasing at a desired instant a sufficient amount of energy to carry out the remote-controlled trip action.

Alternatively, the switch may be designed for remote-controlled tripping into position Trip from position O. In this case, the switch could be closed (into position I) in a remote-controlled manner. It is further possible to contemplate switch designs different from those described above having, for instance, the sliding members and spring-arming plates moving along circular paths.

What is claimed is:

1. Switch device for controlling electrical equipment, said device comprising:

a switch housing (28) with stationary contact surfaces (26) disposed therein serving to provide an electrical contact;

a body piece (15) engaged with the housing (28);

movable contact surfaces (25) suitable for bringing into a contact with said stationary contact surfaces (26) so as to form an electrical contact;

at least one sliding member (14) disposed in said body piece (15) so as to be reciprocatingly movable in regard to said body piece (15), the movement of said sliding member (14) providing an electrical contact of said movable contact surfaces (25) with said stationary contact surfaces (26);

means (6, 18, 22) for latching said sliding member (14) either in a closed position of the switch, wherein said electrical contact is formed, or in an open position of the switch, wherein said electrical contact is opened, and further unlatching said sliding member (14) from said positions;

at least one spring-arming plate (11) engaged with said body piece (15) so as to be movable in parallel with the movement of said sliding member (14);

at least one elastic member (10) serving to transmit said movement of said spring-arming plate (11) to said sliding member (14);

means (33, 34, 35) for locking said sliding member (14) into a third position between said closed and open positions and further for unlatching said sliding member (14) from said third position;

another set of means (30) acting on said means (6, 18, 22) for latching said sliding member (14) in the closed or open position of the switch so as to unlatch said sliding member (14) from said closed or open position; and means (31) disposed in said body piece (15) so as to store/release energy for transferring said sliding member (14) from said closed/open position into said third position.

2. A switch device according to claim 1, characterized by means (32) for conditionally interlocking the function of said means (33, 34, 35) adapted to transfer said sliding member (14) into said third position.

3. A switch device according to claim 1, characterized in that said means adapted to transfer said sliding member (14) into said third position comprise a latch slot (33) made to said sliding member (14) at its side parallel to its movement direction, a brake piece (34) adapted into said body piece (15) so as to be movable toward said side of said sliding member (14), said brake piece having a tip suitable for entering said latch slot (33), and elastic elements such as springs adapted into a space remaining between said brake piece (34) and the interior of said body piece (15), said elastic elements serving to push said tip of said brake piece (34) into said latch slot (33) in order to latch said sliding member with the provision that the tip of said brake piece (34) and said latch slot (33) coincide and no mechanical interlock (32) is imposed on the movement of said brake piece (34).

4. A switch device according to claims 2 and 3, characterized in that said means for conditionally interlocking the entry of said brake piece (34) into said latch slot (33) comprise an interlock claw (32) attached to the side of said spring-arming plate (11) facing said brake piece (34), whereby said interlock claw has an elongated part aligned parallel to said side of said plate and another part serving to outdistance said elongated part from said side of said plate.

5. A switch device according to claim 4, characterized in that the tip of said brake piece (34) is provided with an opening aligned parallel to that side of said spring-arming plate (11) which is closest to said brake piece (34), and said elongated part of said interlock claw (32) is adapted capable of entering through said opening.

6. A switch device according to claim 3, characterized in that means for lifting said brake piece (34) off from said latch slot (33) and for unlatching said sliding member (14) comprise a projection (35) made to the side of said spring-arming plate (11) facing said brake piece (34) and further comprise a slanted surface made on said projection (35) so as to begin flush said side of said spring-arming plate (11) and extending slanted until flush with said side of said sliding member (14), or slightly overextending the same, said slanted surface serving, under the force exerted by a suitable movement of said spring-arming plate (11) to lift said brake piece (34) off from its position in which it locks the movement of said sliding member (14).

7. A switch device according to claim 1, characterized in that said second set of means for unlatching said sliding member (14) from the closed/open position of the switch comprise an elongated trip lever (30) which is partially located both outside and inside said switch body piece (15) and is adapted to affect said means (18, 22) for locking the movement of said sliding member (14) so as to unlatch the movement of said sliding member (14).

8. A switch device according to claim 7, characterized in that said trip lever (30) is adapted for electromagnetic actuation by means of a solenoid.

9. A switch device according to claim 1, characterized in that said means adapted to store/release energy for moving said sliding member (14) from said closed/open position into said third position comprise at least one spring (31) mounted between said body piece (15) and said spring-arming plate (11), each of said at least one spring (31) is armable by moving said spring-arming plate (11), and the energy stored by said at least one spring (31) is releasable in a manner causing the movement of said spring-arming plate (11).

10. A switch device according to claim 1, characterized by contacts connected to said means (33, 34, 35) for locking said sliding member (14) into said third position, said contacts serving to indicate the latch status of said sliding member (14) into said third position on the basis of the position of said locking means (34).

* * * * *